US007416383B2

(12) United States Patent
Burgess

(10) Patent No.: US 7,416,383 B2
(45) Date of Patent: Aug. 26, 2008

(54) PUMP HOUSING ASSEMBLY WITH LINER

(75) Inventor: Kevin Edward Burgess, Carlingford (AU)

(73) Assignee: Weir Warman, Ltd. (AU)

( * ) Notice: Subject to any disclaimer, the term of this patent is extended or adjusted under 35 U.S.C. 154(b) by 0 days.

(21) Appl. No.: 10/570,421

(22) PCT Filed: Aug. 30, 2004

(86) PCT No.: PCT/AU2004/001153

§ 371 (c)(1),
(2), (4) Date: Mar. 2, 2006

(87) PCT Pub. No.: WO2005/024243

PCT Pub. Date: Mar. 17, 2005

(65) Prior Publication Data

US 2007/0014662 A1 Jan. 18, 2007

(30) Foreign Application Priority Data

Sep. 4, 2003 (AU) ..... 2003904804

(51) Int. Cl.
*F04D 29/42* (2006.01)

(52) U.S. Cl. ..... 415/196

(58) Field of Classification Search ..... 415/128, 415/172.1, 173.3, 173.4, 196–197, 214.1
See application file for complete search history.

(56) References Cited

U.S. PATENT DOCUMENTS

| | | | | |
|---|---|---|---|---|
| 797,058 | A * | 8/1905 | Hedlund | 415/196 |
| 1,952,179 | A * | 3/1934 | Milkowski et al. | 415/196 |
| 1,958,108 | A | 5/1934 | Milkowski | |
| 1,967,182 | A * | 7/1934 | Allen | 415/197 |
| 2,110,079 | A | 3/1938 | Butler | |
| 2,255,239 | A * | 9/1941 | Allen | 415/197 |
| 3,018,736 | A | 1/1962 | Clay | |
| 3,090,319 | A | 5/1963 | Musgrove | |
| 4,722,664 | A * | 2/1988 | Wissman | 415/197 |
| 4,917,571 | A | 4/1990 | Hyll et al. | |
| 5,127,800 | A | 7/1992 | Hyll et al. | |
| 5,197,863 | A * | 3/1993 | Dardis et al. | 417/68 |
| 5,513,954 | A | 5/1996 | Bourgeois | |
| 6,582,191 | B2 | 6/2003 | Addie et al. | |

FOREIGN PATENT DOCUMENTS

| | | |
|---|---|---|
| AU | AU 615 945 B2 | 10/1991 |
| FR | 2 218 489 A1 | 9/1974 |

OTHER PUBLICATIONS

Karassik, et al. (Editors, "Pump Handbook", McGraw-Hill Book Company, 1976, pp. 2-37, 2-38, Figures 12 and 13.

* cited by examiner

*Primary Examiner*—Christopher Verdier
(74) *Attorney, Agent, or Firm*—Morriss O'Bryant Compagni

(57) ABSTRACT

A pump housing assembly which includes a pump casing and a liner, the pump casing including at least two parts which are adapted to be connected together in an assembled position wherein the pump casing includes opposed front and rear sides, the at least two parts of the pump casing when in the assembled position have a common junction region which is disposed within one or more planes which pass through the front and rear sides of the pump casing.

8 Claims, 4 Drawing Sheets

PUMP HOUSING ASSEMBLY WITH LINER

This invention relates generally to pumps such as for example end suction centrifugal pumps that have an outer casing and an internal liner. The invention is particularly suitable for slurry pumps that have an outer casing for withstanding the pressure and pipe loadings and an internal liner that is wear resistant and which in turn is supported by the outer casing.

Centrifugal slurry pumps typically utilise a cast outer casing made in Cast Iron or Ductile Iron with an internal liner moulded from a wear resisting elastomer compound. The casing and the liners are traditionally manufactured in two parts or halves held together with bolts at the periphery of the casing. When assembled the two parts form a pump housing having a front side with an inlet therein and a rear side with a pumping chamber therein in which is disposed an impeller mounted for rotation on an impeller shaft. The impeller shaft enters the pumping chamber from the rear side and an outlet is provided at the peripheral side edge. The casing and liner halves are convex on the outside and concave shape on the inside. The liners normally have a metal skeleton moulded inside the elastomer which helps maintain its shape but also provides attachment points for bolts or studs to fix the liner into the casing halves. The two parts join along a plane which is generally perpendicular to the axis of rotation of the pump impeller.

During assembly, the two liner halves must be squeezed together at their periphery by the casing and casing bolts to effect a pressure tight seal. The resulting joint line is a vulnerable wear area in the pump, especially as the joint line is adjacent to the impeller discharge. Any misalignment of the liner halves along this joint line will produce steps or gaps in the joint line that will lead to preferential wear. Once wear starts at a local spot, the continued disturbed flow pattern at the step or gap will lead to an accelerated wear point and in the worst case localised wear will cause the liner to be worn through thereby exposing the pressure containing casing to wear.

It is an object of the present invention to provide a pump housing assembly which alleviates one or more of the aforementioned disadvantages.

According to one aspect of the present invention there is provided a pump housing assembly which includes a pump casing and a liner, the pump casing including at least two parts which are adapted to be connected together in an assembled position wherein the pump casing includes opposed front and rear sides, the two parts of the pump casing when in the assembled position have a common junction region which is disposed within one or more planes which pass through the front and rear sides of the pump casing when in the assembled position.

When in the assembled position, the liner is disposed within the pump casing and forms a pumping chamber for an impeller rotatable about a rotation axis which extends between the front and rear sides of the pump casing.

In one form of the invention the two parts of the pump casing have the common junction region disposed in a plane which is aligned with the axis of rotation of the impeller.

Desirably, the liner is formed of one piece from an elastomer such as for example, rubber, synthetic rubber or the like. The liner may include annular flanges on each side thereof which are adapted to be clamped between the two casing parts in the assembled position. The flanges may include sealing portions thereon. The sealing portions may be adapted to be received within a cavity formed between the pump casing and a pump end plate assembly. The sealing portion may be generally wedge shaped formed integral with the liner and responsive to pressures produced before and during operation of the pump. This may form a separate aspect of the invention.

Preferred embodiments of the invention will herein after be described with reference to the accompanying drawings, and in those drawings.

Figure 1:
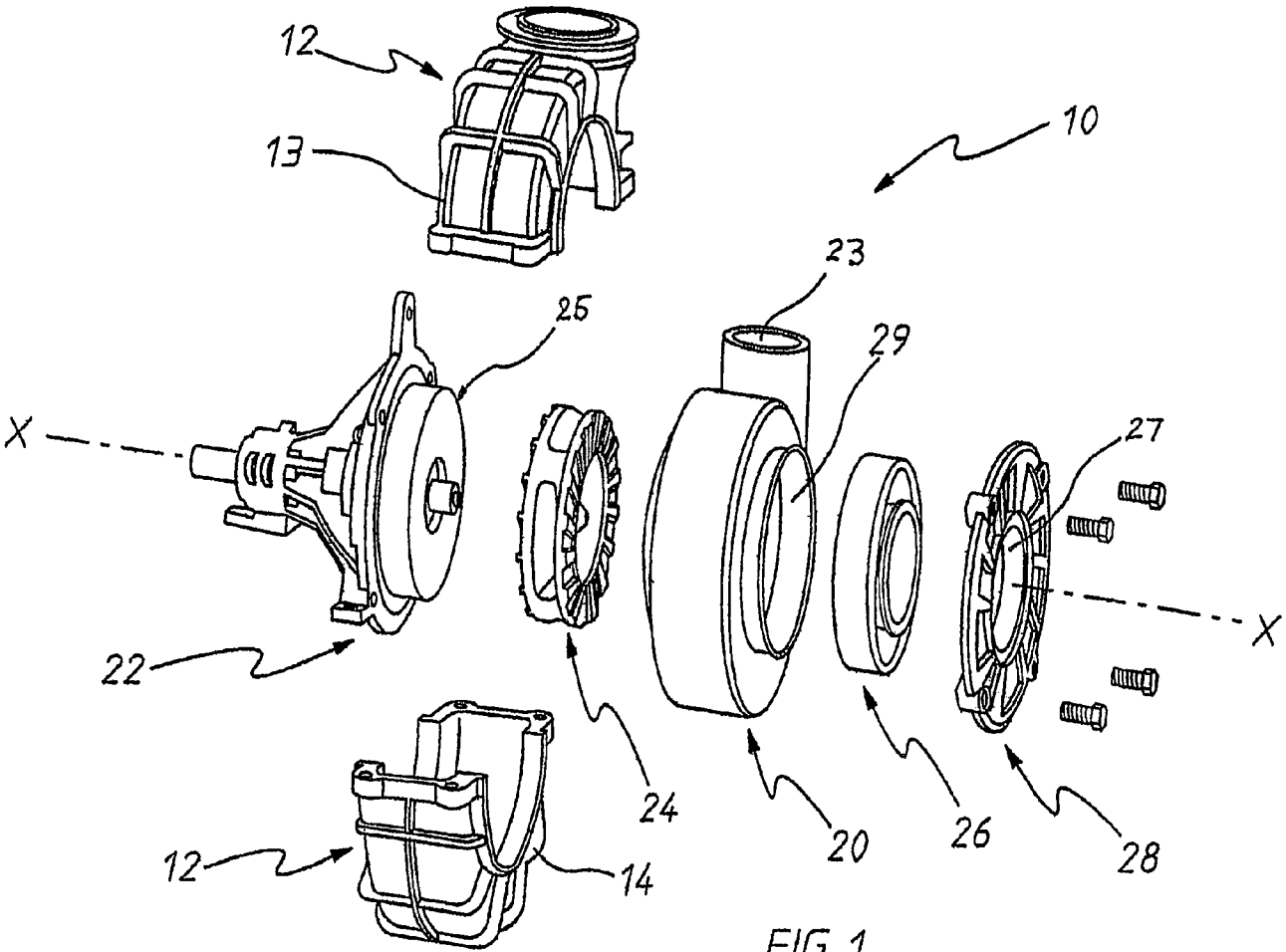
FIG. 1 is an exploded view of a pump according to the present invention.
Figure 2:
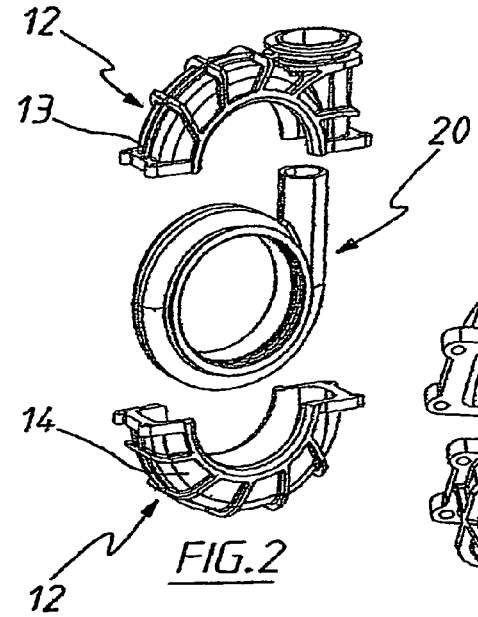
FIG. 2 is an exploded view of a pump housing assembly according to the present invention.

Referring to FIG. 1 of the drawings there is shown an exploded view of a pump generally indicated at 10 which includes a pump casing 12 having two parts 13 and 14 which can be assembled together, an elastomeric liner 20, a drive shaft assembly 22, an impeller 24, back and front side liners 25 and 26 (the front side liner is often referred to as the "throat bush") and an end plate 28.

In an assembled position the impeller 24 is disposed within a pump chamber 29 and operatively connected to drive shaft assembly 22 for rotation and about rotation axis X-X. Slurry is drawn into the pump chamber 29 via inlet 27 and discharged through outlet 23 as is conventional.

Figure 3:
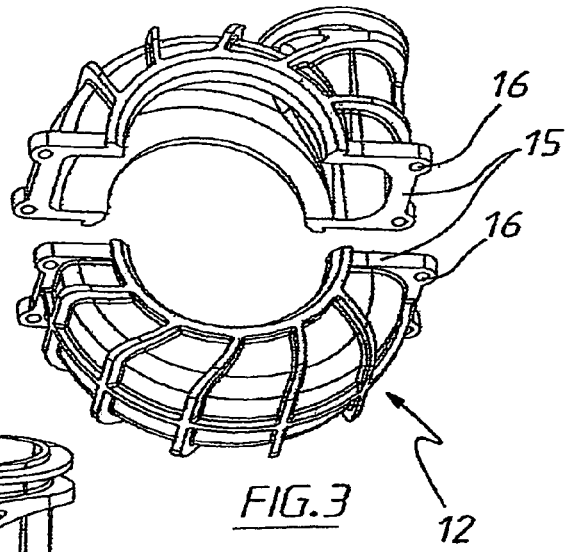
FIGS. 3 and 4 are schematic illustrations of the pump casing of the assembly shown in FIGS. 1 and 2.
Figure 4:
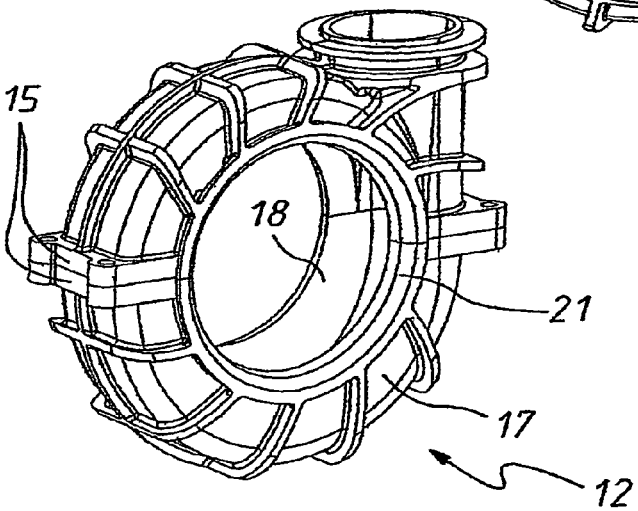

The pump casing 12 is best seen in FIGS. 3 and 4 and includes two parts 13 and 14 which can be fitted together. Flanges 15 have apertures 16 therein for receiving mounting bolts to hold the two parts together. In the assembled position the casing includes a front side 17 having an inlet 21 therein and a rear side 18 to which the shaft assembly is operatively connected. The two parts 13 and 14 are fitted together in a plane which contains the axis of rotation X-X. Thus, the plane extends through the front and rear sides 17 and 18 of the casing.

Figure 5:
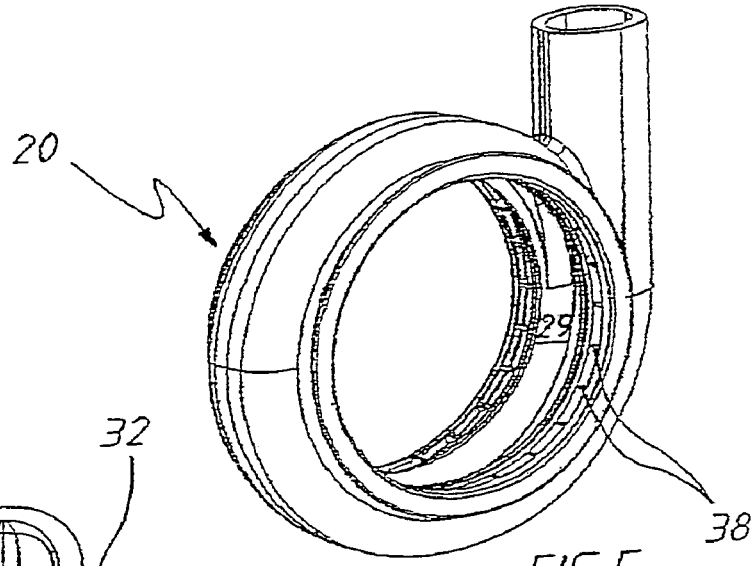
FIGS. 5 to 7 are schematic illustrations of a liner shown in FIGS. 1 and 2.
Figure 6:
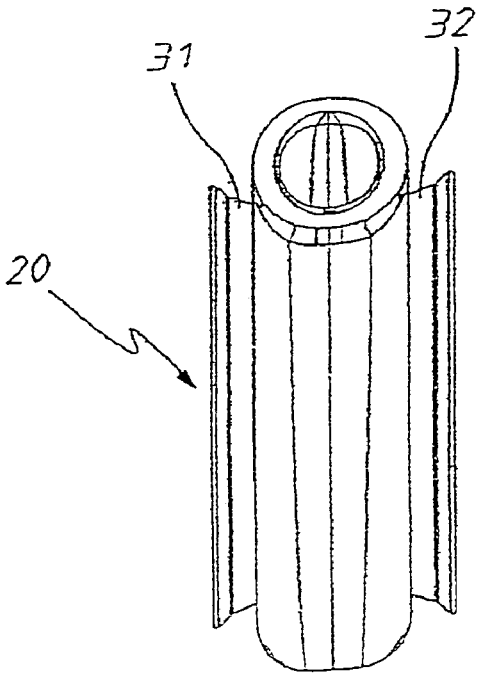
Figure 7:
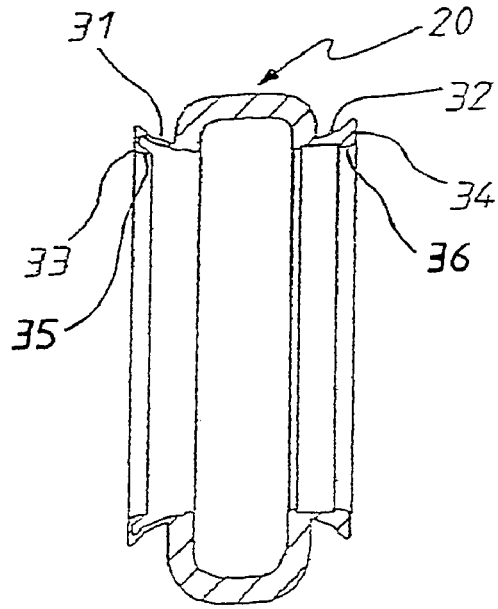

The liner 20 is a one piece structure formed from a suitable elastomeric material. As best seen in FIGS. 5 to 7, the liner 20 includes annular flanges 31 and 32 which are adapted to be clamped between the flanges 15 on the pump casing parts 13 and 14. The flanges 31 and 32 have seal portions 33 and 34 thereon which include flexible lips 35 and 36. The flanges 31 and 32 and associated seal portions 33 and 34 have strengthening ribs 38 on the surface thereof. The section shown in FIG. 7 shows the configuration of the flange and seal portions 31 and 33 whereas the section on the other side is taken through one of the ribs 38.

Figure 8:
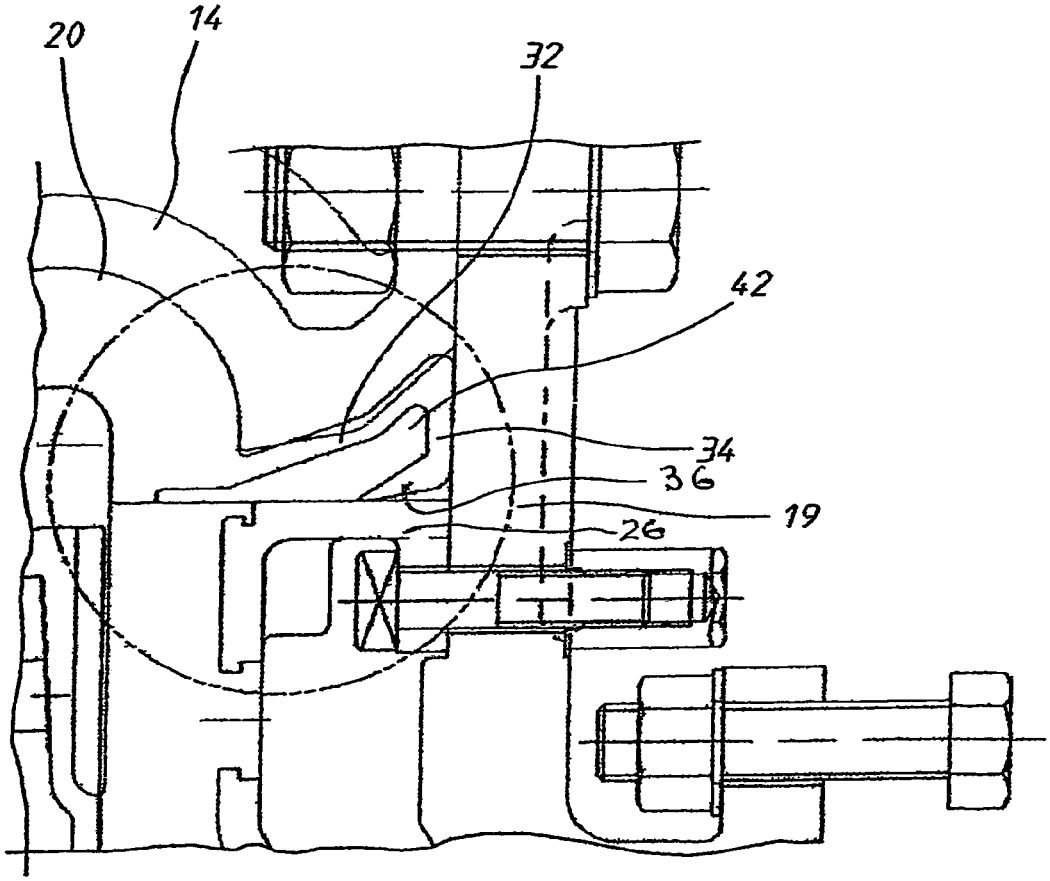
FIG. 8 is a detailed illustration of the seal assembly.

Referring to FIG. 8 the seal assembly is shown in an installed position. The seal portion 34 is disposed within a cavity 42 formed between the casing 14 and the end plate assembly 19. The seal portion 34 fits within the cavity 42. The diameter of the lip 36 is less than the outer diameter of side liner 26 so that the lip is compressed during assembly of the side liner 26 into the main liner 20; that is a seal is effected and lip 36 ensures that the pump holds the static pressure when first filled. The cavity assists controlling the shape and pressure applied to the seal portion. During operation the internal area is pressurised the pressure acting on the seal to increase its sealing capacity.

Because the elastomer liner is produced in one-piece, it avoids the vertical joint line of conventional pumps and the weakness that it introduces due to wear at the joint line. Further the elastomer liner may not require an internal metal skeleton and consequently, the liner can be manufactured to a more uniform thickness or known high wear regions can be made thicker without affecting the liners manufacturability or compromising its wear life. Further, without internal reinforcement, the elastomer liner will more easily conform to the internal shape of the pump casing due to the internal pump pressure generated while the pump is running. Any looseness or gaps between the metal casing and the liner are thereby minimised leading to a more robust liner as looseness and gaps will potentially lead to vibration and hysteresis heating of the elastomer and therefore reduced life.

As described earlier, to enable the liner to be held by the outer metal casing, a thickened region is provided around the liner horizontal centreline and an extension is provided on either side of the liner to allow clamping by the outer metal casing. The extension on either side of the rubber liner further includes an integral seal which is activated initially by the clamping provided by the outer casing and then by the internal pressure of the pumped fluid. With this arrangement, no internal metal skeleton or reinforcing may be required which also more easily facilitates the liner sealing when the liner is moulded in different elastomer compounds.

The liner being one piece without a vertical split line simplifies the casing design as well as obviating the need for casing bolts. The liner projection and seal on either side of the liner is made of a large enough diameter to allow the impeller to be installed through the side of the liner and as well to suit the sideliner.

The outer casing is thereby required to be in two pieces to enable the fitment of the one-piece liner. It will be appreciated that the split line for the casing could be selected from a number of different positions. The requirements for casing bolts therefore reduce to a small number of bolts on the pump centreline. The casing bolts have the dual function of holding the casing halves together as well as squeezing the raised elastomer land to hold the liner in the casing. The sides of the outer metal casing also assist in compressing and holding the elastomer projections and seals on both sides of the elastomer liner and prevent it from both being pushed out under pressure or being sucked in under vacuum. The metal casing can be produced either as two separate pieces or cast as one and then later split in the manufacturing cycle.

The use of a one-piece liner and two piece casing assists to lower maintenance costs. In most cases, the pump discharge pipework can be left attached to the pump. By removing the pump's suction pipework, front liner and impeller, it is possible to gain access to the pump internals for inspection.

The casing design may or may not have ribs for high-pressure applications. The casing bolts are designed to take the full design pressure without passing their elastic limit.

The reference to any prior art in this specification is not, and should not be taken as, an acknowledgment or any form of suggestion that that prior art forms part of the common general knowledge in Australia.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

The invention claimed is:

1. A pump housing assembly which includes a pump casing and a liner, the pump casing including at least two parts which are adapted to be connected together in an assembled position wherein the pump casing includes opposed front and rear sides, the at least two parts of the pump casing when in the assembled position have a common junction region which is disposed within one or more planes which pass through the front and rear sides of the pump casing when in the assembled position, the liner being of one piece and of an elastomer material and which includes annular flanges on each side thereof which are adapted to be clamped between the at least two casing parts in the assembled position, wherein the flanges include sealing portions thereon, the sealing portions being adapted to be received within a cavity formed between the pump casing and a pump end plate assembly, and wherein the sealing portions are generally wedge-shaped, formed integrally with the liner and responsive to pressures produced during operation of the pump.

2. A pump housing assembly according to claim 1 wherein, when in the assembled position, the liner is disposed within the pump casing and forms a pump chamber for an impeller rotatable about a rotation axis which extends between the front and rear sides of the pump casing.

3. A pump housing assembly according to claim 2 wherein the two parts of the pump casing have the common junction region disposed in a plane which is aligned with the axis of rotation of the impeller.

4. A pump housing assembly according to claim 1 wherein the at least two parts of the pump casing have the common junction region disposed in a plane which is aligned with an axis of rotation of an impeller positioned through said pump casing.

5. A pump housing assembly according to claim 1 wherein the liner is free of any metal reinforcement.

6. A pump housing assembly which includes a pump casing and a liner, the pump casing including at least two parts which are adapted to be connected together in an assembled position, wherein the pump casing includes opposed front and rear sides, the at least two parts of the pump casing when in the assembled position have a common junction region which is disposed in a plane which is aligned with an axis of rotation of an impeller positioned through said pump casing, the liner being of one piece and of an elastomer material and which includes annular flanges on each side thereof which are adapted to be clamped between the at least two casing parts in the assembled position, wherein the flanges include sealing portions thereon, the sealing portions being adapted to be received within a cavity formed between the pump casing and a pump end plate assembly, and wherein the sealing portions are generally wedge shaped formed, integral with the liner and responsive to pressures produced during operation of the pump.

7. A pump housing assembly according to claim 6 wherein, when in the assembled position, the liner is disposed within the pump casing and forms a pump chamber for an impeller rotatable about the rotation axis which extends between the front and rear sides of the pump casing.

8. A pump housing assembly which includes a pump casing and a liner, the pump casing including at least two parts which are adapted to be connected together in an assembled position, wherein the pump casing includes opposed front and rear sides, the at least two parts of the pump casing having a common junction region which is disposed within one or more planes which pass through the front and rear sides of the pump casing when the pump casing is in the assembled position, the liner being of one niece construction made of an elastomer material and having annular flanges on each side thereof which are adapted to be clamped between said at least two casing parts when in the assembled position, and said annular flanges each further comprising a sealing portion adapted to be received within a cavity formed between the said at least two parts of the pump casing and a pump end plate assembly, the sealing portions being generally wedge-shaped in cross section to adapt to the cavity responsive to pressures produced during operation of the pump.

* * * * *